US008405002B2

(12) United States Patent
Petrenko et al.

(10) Patent No.: US 8,405,002 B2
(45) Date of Patent: Mar. 26, 2013

(54) PULSE ELECTROTHERMAL MOLD RELEASE ICEMAKER WITH SAFETY BAFFLES FOR REFRIGERATOR

(75) Inventors: Victor F. Petrenko, Lebanon, NH (US); Gabriel Martinez, Wilder, VT (US); Tae Hee Lee, Seoul (KR); Hong Hee Park, Seoul (KR); Joon Hwan Oh, Seoul (KR); Kwang Ha Suh, Seoul (KR)

(73) Assignee: The Trustees of Dartmouth College, Hanover, NH (US)

( * ) Notice: Subject to any disclaimer, the term of this patent is extended or adjusted under 35 U.S.C. 154(b) by 1100 days.

(21) Appl. No.: 12/340,067

(22) Filed: Dec. 19, 2008

(65) Prior Publication Data

US 2009/0235682 A1 Sep. 24, 2009

Related U.S. Application Data

(60) Continuation-in-part of application No. 11/338,239, filed on Jan. 24, 2006, now Pat. No. 7,638,735, and a continuation-in-part of application No. PCT/US2005/022035, filed on Jun. 22, 2005, said application No. 11/338,239 is a continuation-in-part (Continued)

(51) Int. Cl.
*H05B 3/00* (2006.01)
*F25C 1/24* (2006.01)

(52) U.S. Cl. ..... 219/200; 62/351

(58) Field of Classification Search ..... 219/200, 219/385, 521, 549; 62/351, 407–427, 448, 62/449; 222/146.1, 146.6

See application file for complete search history.

(56) References Cited

U.S. PATENT DOCUMENTS

| | | | |
|---|---|---|---|
| 1,157,344 | A | 10/1915 | Thomson |
| 1,656,329 | A | 1/1928 | Sievert |
| 2,024,612 | A | 11/1933 | Sulzberger |
| 2,205,543 | A | 6/1940 | Rideau et al. |
| 2,496,279 | A | 2/1950 | Ely |
| 2,870,311 | A | 1/1959 | Greenfield |
| 2,988,899 | A | 6/1961 | Heron |
| 3,204,084 | A | 8/1965 | Spencer |
| 3,256,920 | A | 6/1966 | Byers |

(Continued)

FOREIGN PATENT DOCUMENTS

| | | |
|---|---|---|
| BE | 410547 | 7/1935 |
| BE | 528926 | 6/1954 |

(Continued)

OTHER PUBLICATIONS

Petrenko, Victor F., "The effect of static electric fields on ice friction", Journal of Applied Physics, Jul. 15, 1994, pp. 1216-1219, vol. 76, No. 2.

(Continued)

*Primary Examiner* — Sang Paik
(74) *Attorney, Agent, or Firm* — Lathrop & Gage LLP

(57) ABSTRACT

An icemaker and a refrigerator having an icemaker are discussed. The icemaker has pulse-electrothermal ice release and includes an ice-making tray having several ice forming portions in which water is stored and ice is formed; and a housing surrounding the ice-making tray provided with at least one cold air inlet and/or ice ejection port through which cold air is supplied and ice released along a bent channel. The cold air inlet and/or ice ejection ports are baffled to prevent contact with a user's fingers and thereby reduce the possibility of electric shock.

3 Claims, 8 Drawing Sheets

Related U.S. Application Data of application No. 10/939,289, filed on Sep. 9, 2004, now Pat. No. 7,034,257, which is a division of application No. 10/364,438, filed on Feb. 11, 2003, now Pat. No. 6,870,139, application No. 12/340,067, which is a continuation-in-part of application No. PCT/US2007/069478, filed on May 22, 2007, and a continuation-in-part of application No. PCT/US2006/002283, filed on Jan. 24, 2006, said application No. PCT/US2007/069478 is a continuation-in-part of application No. 11/571,231, filed as application No. PCT/US2005/022035 on Jun. 22, 2005, now Pat. No. 7,703,300, said application No. PCT/US2007/069478 is a continuation-in-part of application No. 11/338,239, filed on Jan. 24, 2006, now Pat. No. 7,638,735, and a continuation-in-part of application No. PCT/US2005/022035, filed on Jun. 22, 2005.

(60) Provisional application No. 60/646,394, filed on Jan. 24, 2005, provisional application No. 60/646,932, filed on Jan. 25, 2005, provisional application No. 60/739,506, filed on Nov. 23, 2005, provisional application No. 60/581,912, filed on Jun. 22, 2004, provisional application No. 60/646,394, filed on Jan. 24, 2005, provisional application No. 60/646,932, filed on Jan. 25, 2005, provisional application No. 60/802,407, filed on May 22, 2006, provisional application No. 60/356,476, filed on Feb. 11, 2002, provisional application No. 60/398,004, filed on Jul. 23, 2002, provisional application No. 60/404,872, filed on Aug. 21, 2002.

(56) References Cited

U.S. PATENT DOCUMENTS

| | | | | | |
|---|---|---|---|---|---|
| 3,316,344 | A | | 4/1967 | Kidd | |
| 3,316,345 | A | | 4/1967 | Toms | |
| 3,350,899 | A | * | 11/1967 | Jones et al. | 62/414 |
| 3,359,747 | A | * | 12/1967 | Linstromberg | 62/135 |
| 3,380,261 | A | | 4/1968 | Hendrix et al. | |
| 2,522,199 | A | | 10/1969 | Shreve | |
| 3,572,053 | A | * | 3/1971 | Jacobus et al. | 62/344 |
| 3,621,668 | A | * | 11/1971 | Swerbinsky | 62/77 |
| 3,790,752 | A | | 2/1974 | Boaz | |
| 3,809,341 | A | | 5/1974 | Levin | |
| 3,825,371 | A | | 7/1974 | Roder | |
| 3,835,269 | A | | 9/1974 | Levin | |
| 3,915,883 | A | | 10/1975 | VanMeter | |
| 3,964,183 | A | | 6/1976 | Mouat | |
| 3,971,056 | A | | 7/1976 | Jaskolski | |
| 4,081,914 | A | | 4/1978 | Rautenbach | |
| 4,082,962 | A | | 4/1978 | Burgsdorf | |
| 4,085,338 | A | | 4/1978 | Genrkh | |
| 4,119,866 | A | | 10/1978 | Genrkh | |
| 4,135,221 | A | | 1/1979 | Genrkh | |
| 4,137,447 | A | | 1/1979 | Boaz | |
| 4,190,137 | A | | 2/1980 | Shimada | |
| 4,278,875 | A | | 7/1981 | Bain | |
| 4,321,296 | A | | 3/1982 | Rougier | |
| 4,330,703 | A | | 5/1982 | Horsma | |
| 4,442,681 | A | | 4/1984 | Fischer | |
| 4,531,380 | A | | 7/1985 | Hagen | |
| 4,571,860 | A | | 2/1986 | Long | |
| 4,638,960 | A | | 1/1987 | Straube | |
| 4,690,353 | A | | 9/1987 | Haslim | |
| 4,732,351 | A | | 3/1988 | Bird | |
| 4,737,618 | A | | 4/1988 | Barbier | |
| 4,756,165 | A | * | 7/1988 | Chestnut et al. | 62/135 |
| 4,760,978 | A | | 8/1988 | Schuyler | |
| 4,773,976 | A | | 9/1988 | Vexler | |
| 4,798,058 | A | | 1/1989 | Gregory | |
| 4,814,546 | A | | 3/1989 | Whitney | |
| 4,820,902 | A | | 4/1989 | Gillery | |
| 4,862,055 | A | | 8/1989 | Maruyama | |
| 4,875,644 | A | | 10/1989 | Adams | |
| 4,887,041 | A | | 12/1989 | Mashikian | |
| 4,897,597 | A | | 1/1990 | Whitener | |
| 4,950,950 | A | | 8/1990 | Perry | |
| 4,985,313 | A | | 1/1991 | Penneck | |
| 5,057,763 | A | | 10/1991 | Torii et al. | |
| 5,109,140 | A | | 4/1992 | Nguyen | |
| 5,112,449 | A | | 5/1992 | Jozefowicz | |
| 5,143,325 | A | | 9/1992 | Zieve | |
| 5,144,962 | A | | 9/1992 | Counts | |
| 5,218,472 | A | | 6/1993 | Jozefowicz | |
| 5,344,696 | A | | 9/1994 | Hastings | |
| 5,398,547 | A | | 3/1995 | Gerardi | |
| 5,408,844 | A | | 4/1995 | Stokes | |
| 5,411,121 | A | | 5/1995 | LaForte | |
| 5,441,305 | A | | 8/1995 | Tabar | |
| 5,496,989 | A | | 3/1996 | Bradford | |
| 5,523,959 | A | | 6/1996 | Seegmiller | |
| 5,551,288 | A | | 9/1996 | Geraldi | |
| 5,582,754 | A | | 12/1996 | Smith | |
| 5,605,418 | A | | 2/1997 | Watanabe | |
| 5,744,704 | A | | 4/1998 | Hu | |
| 5,861,855 | A | | 1/1999 | Arsenault | |
| 5,873,254 | A | | 2/1999 | Arav | |
| 5,886,321 | A | | 3/1999 | Pinchock | |
| 5,902,962 | A | | 5/1999 | Gazdzinski | |
| 5,934,617 | A | | 8/1999 | Rutherford et al. | |
| 5,947,418 | A | | 9/1999 | Bessierre | |
| 6,018,152 | A | | 1/2000 | Allaire | |
| 6,027,075 | A | | 2/2000 | Petrenko | |
| 6,031,214 | A | | 2/2000 | Bost | |
| 6,129,314 | A | | 10/2000 | Giamatl | |
| 6,133,555 | A | | 10/2000 | Brenn | |
| 6,145,787 | A | | 11/2000 | Rolls | |
| 6,193,793 | B1 | | 2/2001 | Long et al. | |
| 6,194,685 | B1 | | 2/2001 | Rutherford | |
| 6,227,492 | B1 | | 5/2001 | Schellhase | |
| 6,237,874 | B1 | | 5/2001 | Rutherford et al. | |
| 6,239,601 | B1 | | 5/2001 | Weinstein | |
| 6,246,831 | B1 | | 6/2001 | Seitz et al. | |
| 6,270,118 | B1 | | 8/2001 | Ichikawa | |
| 6,279,856 | B1 | | 8/2001 | Rutherford | |
| 6,294,765 | B1 | | 9/2001 | Brenn | |
| 6,297,165 | B1 | | 10/2001 | Okumura | |
| 6,297,474 | B1 | | 10/2001 | Kelly | |
| 6,330,986 | B1 | | 12/2001 | Rutherford | |
| 6,396,172 | B1 | | 5/2002 | Couture | |
| 6,427,946 | B1 | | 8/2002 | Petrenko | |
| 6,438,988 | B1 | * | 8/2002 | Paskey | 62/353 |
| 6,492,629 | B1 | | 12/2002 | Sopory | |
| 6,558,947 | B1 | | 5/2003 | Lund | |
| 6,653,598 | B2 | | 11/2003 | Petrenko | |
| 6,693,786 | B2 | | 2/2004 | Petrenko | |
| 6,723,971 | B1 | | 4/2004 | Petrenko | |
| 6,825,444 | B1 | | 11/2004 | Tuan | |
| 6,870,139 | B2 | | 3/2005 | Petrenko | |
| 6,945,068 | B2 | * | 9/2005 | Kim et al. | 62/353 |
| 6,964,177 | B2 | * | 11/2005 | Lee et al. | 62/320 |
| 7,034,257 | B2 | | 4/2006 | Petrenko | |
| 2001/0052731 | A1 | | 12/2001 | Petrenko | |
| 2002/0017466 | A1 | | 2/2002 | Petrenko | |
| 2002/0092849 | A1 | | 7/2002 | Petrenko | |
| 2002/0096515 | A1 | | 7/2002 | Petrenko | |
| 2002/0118550 | A1 | | 8/2002 | Petrenko | |
| 2002/0170909 | A1 | | 11/2002 | Petrenko | |
| 2002/0175152 | A1 | | 11/2002 | Petrenko | |
| 2003/0024726 | A1 | | 2/2003 | Petrenko | |
| 2003/0046942 | A1 | | 3/2003 | Shedivy | |
| 2003/0155467 | A1 | | 8/2003 | Petrenko | |
| 2003/0155740 | A1 | | 8/2003 | Lammer | |
| 2006/0086715 | A1 | | 4/2006 | Briggs | |
| 2007/0045282 | A1 | | 3/2007 | Petrenko | |

FOREIGN PATENT DOCUMENTS

| | | |
|---|---|---|
| DE | 1476989 | 10/1969 |
| DE | 2510660 A1 | 9/1976 |
| DE | 2510755 | 9/1976 |

| | | | |
|---|---|---|---|
| DE | 3626613 | | 2/1988 |
| DE | 3921900 | C1 | 7/1990 |
| DE | 4440634 | | 7/1996 |
| EP | 1168888 | | 1/2002 |
| FR | 2570333 | | 3/1986 |
| GB | 820908 | | 9/1959 |
| GB | 917055 | A | 1/1963 |
| GB | 2106966 | | 4/1983 |
| GB | 2252285 | A | 5/1992 |
| GB | 2259287 | | 3/1993 |
| GB | 2261333 | | 5/1993 |
| GB | 2319943 | A | 6/1998 |
| JP | 405292638 | A | 11/1993 |
| JP | 407023520 | A | 1/1995 |
| JP | 2005180823 | | 7/2005 |
| JP | 2005180824 | | 7/2005 |
| RU | 2289892 | | 1/2006 |
| SU | 983433 | | 12/1982 |
| WO | WO 00/24634 | | 5/2000 |
| WO | WO 00/33614 | | 6/2000 |
| WO | WO 00/52966 | | 9/2000 |
| WO | WO 01/08973 | | 2/2001 |
| WO | WO 01/49564 | | 7/2001 |
| WO | WO 03/062056 | | 7/2003 |
| WO | WO 03/069955 | | 8/2003 |
| WO | WO 2005/061974 | A | 7/2005 |
| WO | WO 2006/002224 | | 1/2006 |
| WO | WO 2006/081180 | | 8/2006 |

OTHER PUBLICATIONS

Petrenko, Victor F. and Colebeck, Samuel C., "Generation of electric fields by ice and snow friction", Journal of Applied Physics, May 1, 1995, pp. 4518-4521, vol. 77, No. 9.
"Everstart Automotive", http://www.everstart-batteries.com/products/use/automotive.asp, May 5, 2003, 1 page.
"Maxwell Technologies: Ultracapacitors-Boostcap PC2500", http://www.maxwell.com/ultracapacitors/products/PC2500.html, May 5, 2003, 2 pages.
Petrenko, V.F. and Schulson, E.M., "Action of Electric Fields on the Plastic Deformation of Pure and Doped Ice Single Crystals", Philosophical Magazine A, 1993, pp. 173-185, vol. 67, No. 1.
Reich, A., AIA 94-0714, "Interface Influences Upon Ice Adhesion to Airfoil Materials", BFGoodrich Aerospace/De-icing Systems, Brecksville/Uniontown, OH (32nd Aerospace Sciences Meeting and Exhibit, Jan. 10-13, 1994), pp. 1-8.
"Icing Wind Tunnel", Meeting the Challenges of Ice Testing in a World-Class Facility—BFGoodrich Aerospace Ice Protection Systems, 4 pages.
Phillips, Edward H., "New Goodrich Wind Tunnel Tests Advanced Aircraft De-Icing Systems", Uniontown, Ohio, Aviation Week Magazine, Oct. 3, 1988, 3 pages.
"The Evolution of Ice Protection Creates a Revolution in Ice Detection", BFGoodrich Aerospace Ice Protection Systems, 2 pages.
Petrenko, Victor F., "Electromechanical Phenomena in Ice", Thayer School of Engineering Special Report 96-2; Feb. 1996.
Petrenko, Victor F., "Study of the Surface of Ice, Ice/Solid and Ice/Liquid Interfaces with Scanning Force Microscopy", Journal of Physical Chemistry B., 1997, 1001: 6285-6289.
Petrenko, V.F. and Peng, S., "Reduction of Ice Adhesion to Metal by Using Self-Assembling Monolayers (SAMs)", Canadian Journal of Physics, Jan./Feb. 2003, pp. 387-393, vol. 81, No. ½.
Petrenko, Victor F and Schulson, E.M., "The effect of static electric fields on proton conductivity of single ice crystals", Philosophical Magazine B, 1992, pp. 341-353, vol. 66, No. 3.
Courville, Zoe and Petrenko, V.F., "De-icing Layers of Interdigitated Microelectrodes", Mat. Res. Soc. Symp. Proc. 2000, pp. 329-334, vol. 604.
Petrenko, V.F. and Qi, Suogen, "Reduction of Ice Adhesion to Stainless Steel by Ice Electrolysis", Journal of Applied Physics, pp. 5450-5454, Nov. 1999, vol. 86, No. 10.
Petrenko, Victor F. & Whitworth, Robert W., Physics of Ice, © 1999, pp. 1-373, Oxford University Press, Oxford, New York.
Petrenko, V.F. et al.; "Pulse Electrothermal De-Icing", Proceedings of the International Offshore and Polar Engineering Conference,; May 30, 2003; pp. 435-.
Incropera, F.P. & DeWitt, D.P.; Fundamentals of Heat and Mass Transfer; 5th Ed.; John Wiley & Sons; 2002; pp. 596-601.
Canadian Application 2,476,202 Response to Restriction filed Aug. 22, 2008; 17 pages.
Canadian Application 2,476,202 Restriction dated Feb. 22, 2008; 2 pages.
Chinese Application No. 03808185.7 English Translation of Office Action dated May 9, 2008.
Chinese Application No. 200680003031.6 Office Action with English Translation, Oct. 17, 2008; 23 pages.
European Application 03709059 Comm. Pursuant to Article 96(2) EPC; Aug. 14, 2007; 4 pages.
European Application 03709059 Comm. Pursuant to Article 96(2) EPC; Jun. 9, 2006; 6 pages.
European Application 03709059 Comm. Pursuant to Article 96(2) EPC; Jan. 8, 2007; 5 pages.
European Application 03709059 Decision to Grant a European Patent; Jul. 18, 2008;2 pages.
European Application 05761644.3 Comm. Pursuant to Rules 109 and 1110 EPC; Feb. 13, 2007; 2 pages.
European Application 05761644.3; Communication Pursuant to Article 94(3) EPC; Sep. 18, 2008; 3 pages.
European Application 05761644.3; Reply to Communication Pursuant to Article 94(3) EPC; Filed Jan. 28, 2009, 72 pages.
European Application 06719229.4 Comm. Pursuant to Rules 109 and 1110 EPC; Sep. 4, 2007; 2 pages.
Japanese Application 2003-568934; Rejection dated Jan. 11, 2008; 7 pages.
Japanese Application 2003-568934; Response filed Jul. 18, 2008; 22 pages.
Korean Application No. 10-2004-7012335 Certificate of Patent; Patent No. 10-0799779 with English Abstract; Jan. 24, 2008; 3 pages.
Korean Application No. 10-2004-7012335 Office Action; Oct. 24, 2006 with English language Summary of the Office Action; 5 pages.
Korean Application No. 10-2004-7012335; Office Action; Apr. 27, 2007 with English language Summary of the Office Action; 5 pages.
Korean Application No. 10-2007-7001352 Office Action; Mar. 31, 2008 with English language Summary of the Office Action; 7 pages.
PCT/US00/05665 International Search Report, dated Jun. 26, 2000; 2 pages.
PCT/US00/35529, International Preliminary Examination Report , Jul. 19, 2004; 3 pages.
PCT/US00/35529, International Search Report, Feb. 5, 2001.
PCT/US03/04170, International Preliminary Examination Report dated Dec. 17, 2003; 2 pages.
PCT/US03/04170, International Search Report dated Jul. 1, 2003, 3 pages.
PCT/US03/04170, Written Opinion mailed Sep. 30, 2003; 2 pages.
PCT/US05/022035 International Preliminary Report on Patentability & Written Opinion dated Feb. 15, 2006; 39 pages.
PCT/US05/022035 Response to Written Opinion dated May 15, 2006; 38 pages.
PCT/US05/022035, International Search Report dated Feb. 15, 2006; 5 pages.
PCT/US06/002283 International Search Report dated Sep. 14, 2006; 5 pages.
PCT/US06/002283, International Preliminary Report on Patentability & Written Opinion dated Jul. 24, 2007; 12 pages.
PCT/US06/002283, Invitation to Pay Additional Fees Jul. 28, 2006; 6 pages.
PCT/US07/69478, International Search Report and Written Opinion mailed Jul. 21, 2008; 13 pages.
PCT/US08/55928, International Search Report & Written Opinion mailed Jan. 13, 2009, 16 pages.
PCT/US08/55928, Invitation to Pay Additional Fees & Partial Search Report, mailed Oct. 31, 2008,4 pages.
PCT/US08/55928, Response to Written Opinion, filed Apr. 13, 2009.
PCT/US2008/081902, Invitation to Pay Additional Fees, mailed Apr. 3, 2009, 10 pages.
PCT/US98/12421, International Search Report (Nov. 3, 1998); 3 pages.
PCT/US99/25124,International Search Report, Jan. 5, 2000, 2 pages.

PCT/US99/28330, International Search Report, May 5, 2000; 2 pages.
Russian Application 2004127250; Decision on Grant; Jun. 5, 2006.
Russian Application 2004127250; English Translation of Office Action; Aug. 2005; 4 pages.
U.S. Appl. No. 10/364,438 from Apr. 5, 2004 through Nov. 2, 2004, 44 pages.
U.S. Appl. No. 10/939,289 from Mar. 28, 2005 through Feb. 21, 2006, 45 pages.
U.S. Appl. No. 11/338,239 from Jan. 17, 2007 through Mar. 24, 2009, 138 pages.
U.S. Appl. No. 11/409,914 from Feb. 12, 2007 through Apr. 14, 2009; 110 pages.
Ukrainian Application 20040907418 Decision on Grant dated Jan. 17, 2007; pp. 1-2.

* cited by examiner

PULSE ELECTROTHERMAL MOLD RELEASE ICEMAKER WITH SAFETY BAFFLES FOR REFRIGERATOR

CLAIM TO PRIORITY

This application is a continuation-in-part of commonly-owned and U.S. patent application Ser. No. 11/338,239 filed 24 Jan. 2006, now U.S. Pat. No. 7,638,735 which claims the benefit of priority to U.S. Provisional Patent Applications Nos. 60/646,394, filed 24 Jan. 2005, 60/646,932, filed 25 Jan. 2005, and 60/739,506, filed 23 Nov. 2005. U.S. patent application Ser. No. 11/338,239 is also a continuation-in-part of commonly-owned PCT Application No. PCT/US2005/22035 filed 22 Jun. 2005, which claims the benefit of priority to U.S. Provisional Patent Applications Nos. 60/581,912, filed 22 Jun. 2004, 60/646,394, filed 24 Jan. 2005, and 60/646,932, filed 25 Jan. 2005. U.S. patent application Ser. No. 11/338,239 is also a continuation-in-part of commonly-owned and U.S. patent application Ser. No. 10/939,289 filed 9 Sep. 2004, now U.S. Pat. No. 7,034,257, which is a divisional application that claims the benefit of priority to U.S. patent application Ser. No. 10/364,438, filed 11 Feb. 2003, now U.S. Pat. No. 6,870,139, which claims the benefit of priority to U.S. Provisional Patent Applications Nos. 60/356,476, filed 11 Feb. 2002, 60/398,004, filed 23 Jul. 2002, and 60/404,872, filed 21 Aug. 2002.

This application is also a continuation in part of PCT Application No. PCT/US2007/069478, filed May 22, 2007, which claims benefit of priority to commonly-owned U.S. Provisional Patent Application No. 60/802,407, filed 22 May 2006. PCT Application No. PCT/US2007/069478 is also a continuation-in-part of commonly-owned PCT/US2006/002283, filed 24 Jan. 2006, which claims the benefit of priority to U.S. Provisional Patent Applications Nos. 60/646,394, filed 24 Jan. 2005, 60/646,932, filed 25 Jan. 2005, and 60/739,506, filed 23 Nov. 2005. PCT Application No. PCT/US2007/069478 is also a continuation-in-part of commonly-owned and U.S. patent application Ser. No. 11/571,231, filed 23 Apr. 2006, now U.S. Pat. No. 7,703,300 which claims the benefit of priority to PCT/US2005/022035, filed 22 Jun. 2005, which claims the benefit of priority to U.S. Provisional Patent Applications Nos. 60/581,912, filed 22 Jun. 2004, 60/646,394, filed 24 Jan. 2005, and 60/646,932, filed 25 Jan. 2005. PCT Application Serial No. PCT/US07/069478 is also a continuation-in-part of commonly-owned and U.S. patent application Ser. No. 11/338,239, filed 24 Jan. 2006, now U.S. Pat. No. 7,638,735 which claims the benefit of priority to U.S. Provisional Patent Applications Nos. 60/646,394, filed 24 Jan. 2005, 60/646,932, filed 25 Jan. 2005, and 60/739,506, filed 23 Nov. 2005. U.S. patent application Ser. No. 11/338,239 is also a continuation-in-part of commonly-owned PCT Application No. PCT/US2005/22035 filed 22 Jun. 2005, which claims the benefit of priority to U.S. Provisional Patent Applications Nos. 60/581,912, filed 22 Jun. 2004, 60/646,394, filed 24 Jan. 2005, and 60/646,932, filed 25 Jan. 2005. U.S. patent application Ser. No. 11/338,239 is also a continuation-in-part of commonly-owned and U.S. patent application Ser. No. 10/939,289, now U.S. Pat. No. 7,034,257, filed 9 Sep. 2004, which is a divisional application that claims the benefit of priority to U.S. patent application Ser. No. 10/364,438, now U.S. Pat. No. 6,870,139, filed 11 Feb. 2003, which claims the benefit of priority to U.S. Provisional Patent Applications Nos. 60/356,476, filed 11 Feb. 2002, 60/398,004, filed 23 Jul. 2002, and 60/404,872, filed 21 Aug. 2002.

All of the above-identified patent applications are incorporated herein by reference.

FIELD OF THE INVENTION

The present invention relates to an icemaker and a refrigerator having an icemaker. More specifically, the present invention relates to a pulse electrothermal icemaker and a refrigerator having the icemaker, wherein the icemaker has a baffled passage for admitting cold air and releasing ice while preventing users from accessing interior components of the icemaker.

BACKGROUND

Generally, an ice-making tray is an apparatus in which ice is made from water by exposure to cold air in a freezing device. In particular, an ice making tray, which stores water in a specific container and makes the stored water into ice by freezing the stored water below the freezing point, is generally used in a refrigerator, a water purifier or vending machine, and an icemaker (hereinafter, referred to as a "refrigerator and so forth").

In the past, a simply configured ice making process, in which an ice-making container filled with water is placed in a freezing chamber below the freezing point and ice is inconveniently taken out of the ice-making container by a user after ice is made, was generally used. However, as living standards rise and technologies develop, more and more refrigerators have automatic icemakers.

Ice making trays are largely classified into thermal icemaking trays and twist icemaking trays according to the type of ice release. The thermal type generally has a heater installed adjacent to the tray to melt and separate ice therefrom, and the twist type is a type in which ice is released by twisting the ice-making tray without using a heater.

A pulse-electrothermal icemaking tray releases ice by applying a brief pulse of electric current through the tray to melt an interface layer and release the ice.

Application of electric current to an icemaking tray can, however, pose risk to users if users are permitted easy access to the icemaking trays.

However, as the ice making tray installed in the icemaker chills water not by itself but by cold air supplied, the ice making tray installed in the icemaker must have a cold air inlet port for sufficiently supplying cold air because cold air must be sufficiently supplied into the ice making tray installed in the icemaker.

Also, an ice outlet must be provided so that ice can be discharged from the icemaker.

SUMMARY

To achieve these objects and other advantages and in accordance with the purpose of the invention, as embodied and broadly described herein, an icemaker having pulse-electrothermal ice release includes an ice making tray having several of ice forming portions in which water is stored and ice is formed; and a housing surrounding the ice making tray provided with at least one cold air inlet and/or ice ejection port through which cold air is supplied and ice released along a bent channel.

In an embodiment, a cold air inlet port is a gap between spaced plates disposed at an upper part of the ice-making tray. In an embodiment, the plates are positioned at different heights and parallel to each other. In another embodiment, a cold air inlet ports may be formed by several slanted block members.

Further, the housing is provided with a slanted inner surface that faces toward the inner side of the housing at a specific angle, and the ice outlet may be a gap between two slanted inner surfaces of the housing. In a particular embodiment, the pair of slanted inner surfaces have a vertically overlapped portion at the lower part of the ice-making tray. Also, the gap that constitutes the ice outlet is preferably less than the maximum width of ice that is formed in the ice-making tray.

In an embodiment, a refrigerator having an icemaker includes: a cabinet provided with a freezing chamber for freezing foods; a door which is hinged to the cabinet in order to selectively open/close the freezing chamber; an ice making tray within the icemaker; and a housing surrounding the ice making tray and provided with a cold air inlet port through which cold air supplied from an upper part of the ice making tray flows to the ice making tray along a bent channel and an ice outlet through which ice moved from the ice making tray is discharged along a bent passage at the lower side.

DETAILED DESCRIPTION OF THE EMBODIMENTS

Reference will now be made in detail to embodiments of the present invention, examples of which are illustrated in the accompanying drawings. However, the present invention is not restricted to the illustrated embodiments, but may be embodied in different ways within in the scope of the invention. The embodiments are described so that the concept of the present invention is sufficiently appreciated by a person skilled in the art. Wherever possible, the same reference numbers will be used throughout the drawings to refer to the same or like parts.

Figure 1:
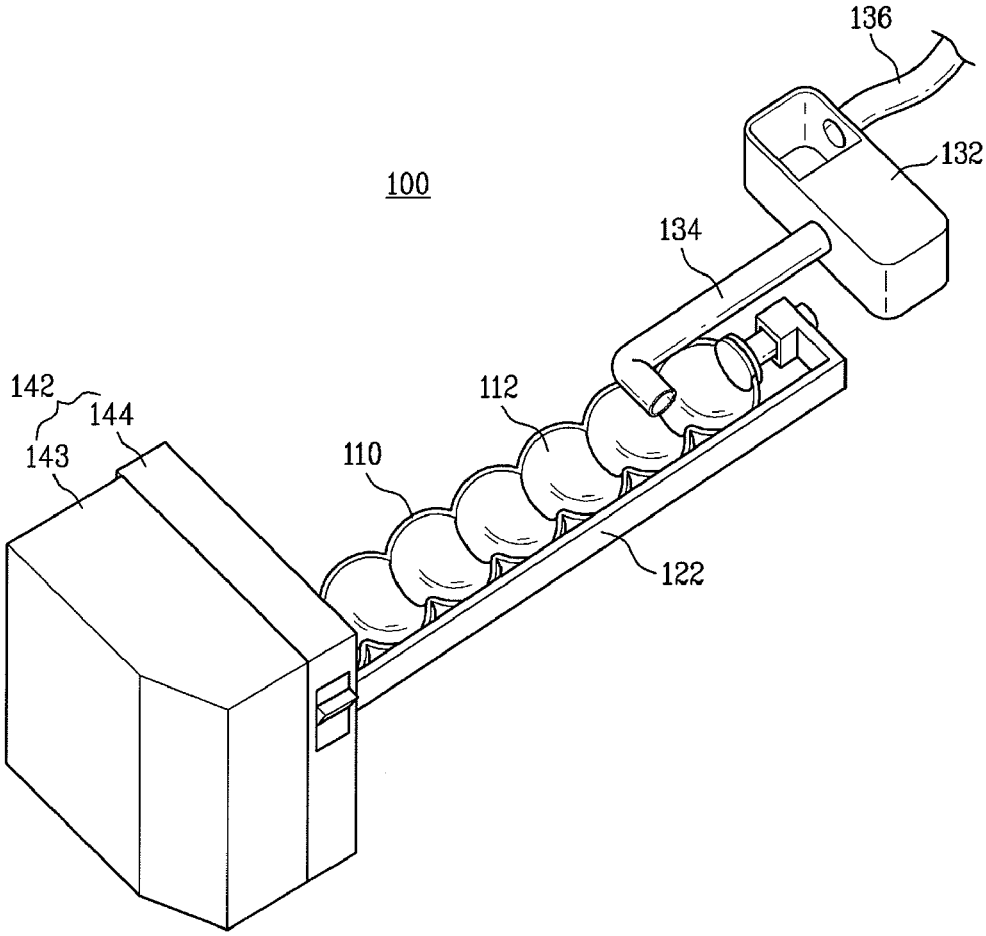
FIG. 1 is a perspective view of an icemaker provided with an ice making tray according to the present invention.
Figure 2:
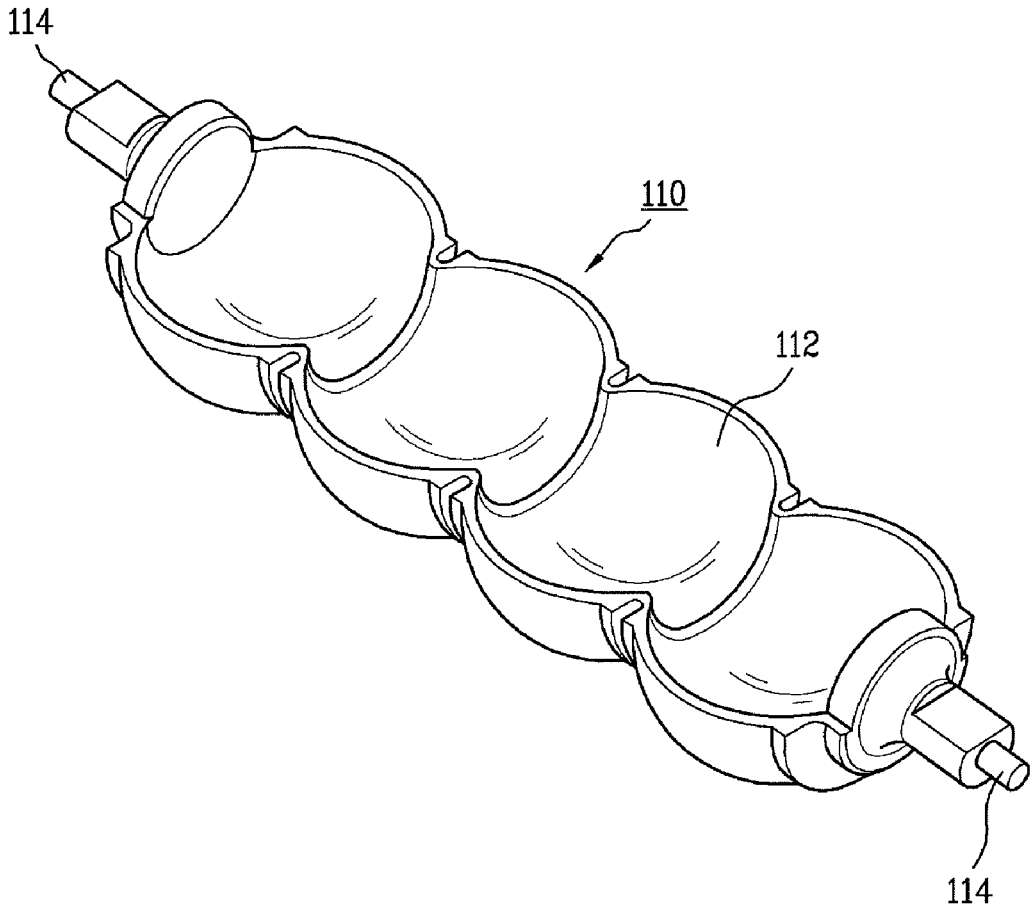
FIG. 2 is a perspective view of an ice making tray according to the present invention.

FIG. 1 is a perspective view showing an icemaking tray provided in an icemaker according to the present invention, and FIG. 2 is a perspective view showing only the icemaking tray.

The icemaker 100 according to the present invention has an ice making tray 110 with apparatus for dispensing water therein, and an icemaking tray cover (not shown) at the upper part of the ice making tray 110 to prevent water from overflowing or splashing.

The ice making tray 110 includes at least one receiving portions 112 receiving water for making ice cubes and provided with an opening through which water is supplied and ice cubes are separated. The icemaking tray 110 may be an assembly of several receiving portions 112.

In variations of this embodiment, the ice-making tray 110 may be configured that receiving portions 112 are arranged in a row as shown, or the receiving portions 112 may be arranged in several rows.

Receiving portions 112 may be formed in various shapes. Specifically, the receiving portions 112 may be formed in a hemisphere shape or in a cube shape. Multiple interchangeable ice making trays 110 having receiving portions 112 of various shapes may be provided such that ice cubes having shape satisfying a particular user's taste and need can be made. It is understood that the receiving portions 112 having complicated shapes such as a star shape and a heart shape can be provided.

Icemaker 100 has a moving portion that moves the ice-making tray 110 to an ice release position so that the after water freezes in icemaking tray 110 the ice can be separated from the ice-making tray 110.

In an embodiment, the moving portion may be configured that it translates the ice-making tray 110. In another embodiment, however the moving portion rotates the ice-making tray 110 about a longitudinal axis so the open upper part of the receiving portions 112 of the ice making tray 110 faces downwards toward the lower part.

The moving portion may further include a pivot 122 that is axially connected to both longitudinal ends of the ice-making tray 110, and a motor (not shown) for rotating the ice-making tray 110.

After completing the ice making process the motor starts and rotates the ice-making tray 110 through an angle of 90°~180°. On one side of the moving portion, a water supply device for supplying water into the ice-making tray 110 is provided. The water supply may include a storage container 132 in which water is stored, and a water supply pipe 134 that supplies water from the storage container 132 to the ice-making tray 110.

The storage container 132 is configured that it can be supplied with water from a water supply hose 136. Also, since a valve (not shown) is provided in a region where the water supply pipe 134 and the storage container 132 are connected, water flows into the ice-making tray 110 only when needed.

The ice making tray 110 is made of an electrical conductor, and the ice making tray 110 generates heat as current is passed through tray 110. This heat melts an interfacial layer of ice thereby separating the ice from the tray 110.

A power supply 142 capable of supplying electric current through the ice-making tray 110 is provided. The power supply device 142 has a power supply 143 and an input control device 144.

The electrical conductor of which the ice making tray 110 may be made of a material including, but not limited to, Copper, Silver, Aluminum, Titanium, stainless steel alloy or aluminum alloy having high electric conductivity, as well as an injection molded electrically conductive plastic.

It is possible to uniformly heat the ice-making tray 110 rapidly by applying electric current through electrode 114.

The ice making tray 110 is configured that electric current flows lengthwise through the ice making tray 110 An electric circuit (not shown) is connected to an electrode 114 (illustrated only at one end) at each end of the tray 110.

As heat is generated by applying an electric current to the ice making tray 110 ice is melted at the contact surface between the receiving portions 112 of the ice making tray 110 and the ice formed therein. While icemaking tray 110 is rotated to face the icemaker bottom, ice attached to the receiving portion 112 separates from the receiving portion 112, and drops from the ice-making tray 110.

The heating of the ice-making tray 110 is produced by a pulse of current controlled by the input control device 144. Here, the input control device 144 may include a resistive circuit, a triac circuit or a coil circuit.

Figure 3A:
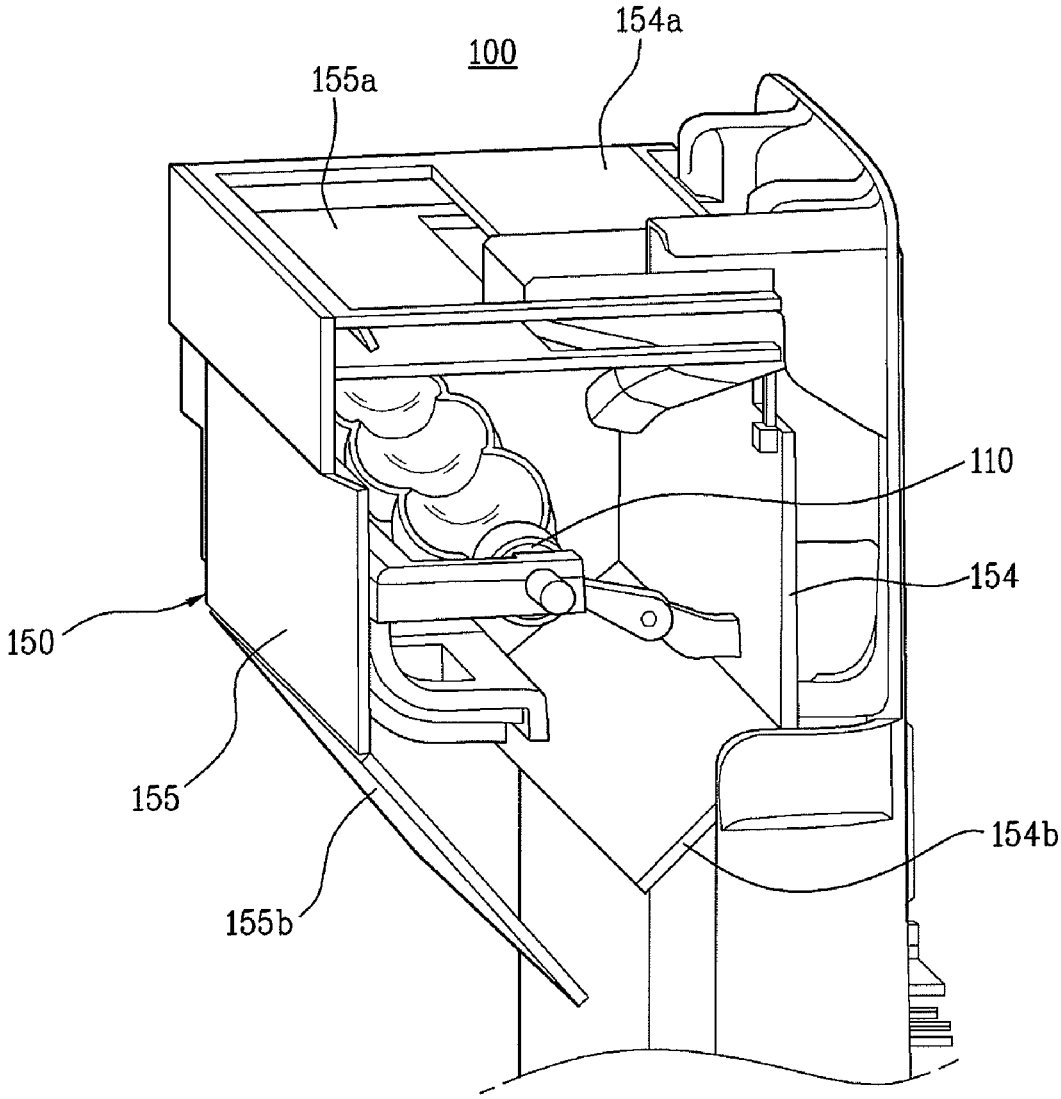
FIG. 3A and FIG. 3B show an icemaker according to a preferred embodiment of the present invention.
Figure 3B:
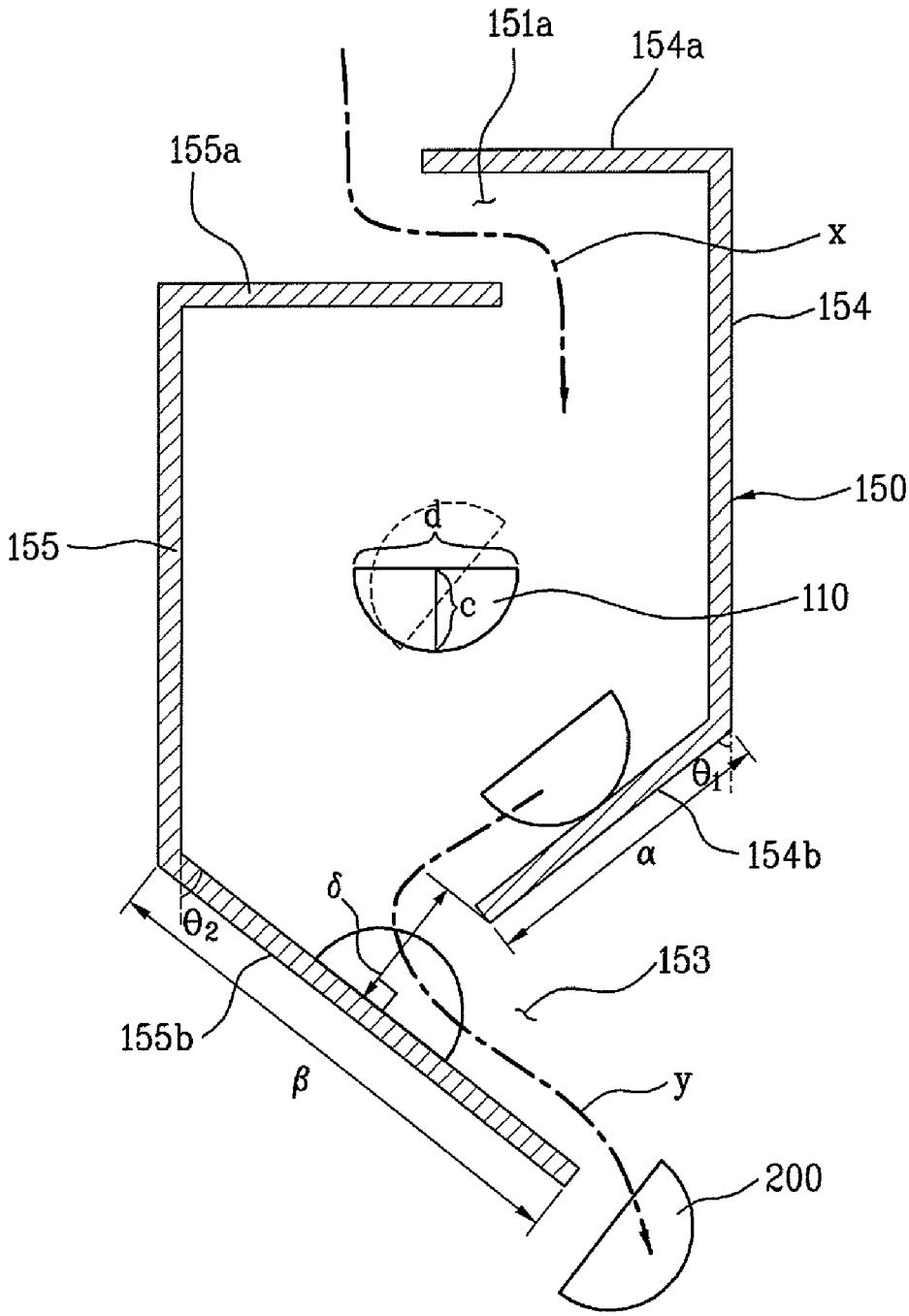

FIG. 3*a* is a perspective view of an icemaker having a housing 150, wherein a side surface of the housing is incised, and FIG. 3*b* is a cross-sectional view schematically showing an icemaker according to the present invention.

The housing 150 of the icemaker 100 surrounds the ice-making tray, and the housing is configured to discharge ice and to receive cold air.

A cold air inlet port 151*a* through which cold air enters is provided at the upper part of the housing. Cold air inlet port 151*a* allows cold air introduced from the upper part of the housing 150 to reach the ice-making tray 110 along a bent channel. The bent or baffled channel prevents users from contacting the tray and being electrically shocked as well as supplying cold air for making ice.

The cold air circulates into the ice-making tray 110 by convection. Therefore, the cold air supplied into the ice-making tray 110 is supplied from the upper part and ice is made by freezing water in the ice-making tray 110.

As shown in FIG. 3*b*, the cold air introduced from the upper part of housing 150 reaches the ice-making tray 110 along the bent channel X.

In the embodiment of FIG. 3*b*, the cold air inlet port 151*a*, through which cold air is supplied, is a gap between spaced plates 154*a*, 155*a*. Plates 154*a*, 155*a* may have a bent and extended portion, and they may be installed at both sides 154, 155 of the housing 150. In an embodiment, plates 154*a*, 155*a* have an overlapped portion at the upper part of the ice-making tray 110.

Plates 154*a*, 155*a* are overlapped at the upper part of the icemaking tray 110 to prevent users from contacting with the ice-making tray 110 and protect users from electrical shock from contacting the icemaking tray 110.

The channel for cold air supplied to the ice-making tray 110 is formed as a bent channel to prevent the user from contact with the icemaking tray 110.

The extended length of the plates 154*a*, 155*a* is preferably set such that the icemaking tray 110 cannot be seen from outside housing 155.

Since the ice making tray 110 cannot be seen from the outside housing 155, then straight metal objects (for example, kitchen utensils such as a knife) inserted by a user into the cold air inlet port 151*a* will not contact tray 110.

Also, the housing is provided with an ice outlet 153 from which ice released from the ice making tray 110 is discharged via a bent passage to prevent the user from contacting the ice making tray 110 though the ice outlet.

The ice-making tray 110 is heated by an electric current to release ice into the ice storage cabinet after the icemaking tray rotates so that the receiving portions face down.

In the embodiment of FIG. 3*b*, the dotted lines indicate the rotated state of the ice-making tray 110. Released ice drops by its own weight, and is discharged to the ice outlet 153 via bent passage Y.

Ice discharged drops through the ice outlet 153, a gap between the slanted inner surfaces 154*b*, 155*b* provided at the lower part of a pair of opposing inner surfaces 154, 155 of housing 150.

The slanted inner surfaces 154*b*, 155*b* may be integrally formed in the inner surfaces 154, 155 as illustrated in FIG. 3*b*, or may be formed separately from the inner surfaces 154, 155. The inner surfaces are bent toward the inner side of the housing at an angle and extended, and the ice outlet 153 is a gap between the slanted inner surfaces 154*b*, 155*b* that are bent and extended.

The ice-making tray may be installed in a refrigerator with the ice-making tray at the door of the freezing chamber. In this case, it is necessary to prevent the hands of users from approaching the ice-making tray 110 of the icemaker from the bottom.

In particular, users of low stature, specifically children, should be prevented from being electrically shocked by inserting their hands into the housing at the lower part of the ice-making tray 110.

Therefore, according to the embodiment shown in FIG. 3*b*, the bent channel Y, from which ice is discharged, is configured that the ice is not vertically dropped, but is collides with the higher inner side surface of the pair of inner side surfaces 154, 155 of the housing and again with the lower inner side surface before discharge.

In this embodiment, the angle of the inner side surface of the housing which is bent and extended at an angle, and the length of the slanted inner surface 154*b*, 155*b* are preferably determined as follows.

That is, the angle $\theta 1$, $\theta 2$ of the bent and extended inner side surface is preferably within the range that can downwardly slide ice without remaining on the bent inner side surface 154*b*, 155*b* even when the ice collides with the inner side surface.

Also, since ice is not downwardly slid where the angle of the bent and extended inner side surface is a steep angle, the angle should be the range that allows ice to be downwardly slide after colliding thereto.

Also, as well as the above described cold air inlet port 151*a*, the respective length $\alpha$, $\beta$ of the slanted inner surface 154*b*, 155*b* has an overlapped portion at the lower part of the ice making tray 110, as the plate constituting the cold air inlet port has an overlapped portion.

The housing 150 is preferably designed such that the ice-making tray cannot be seen from below by extending the respective slanted inner surface 154*b*, 155*b*.

The respective lengths $\alpha$, $\beta$ of the slanted inner surface 154*b*, 155*b* and the angle $\theta 1$, $\theta 2$ of the bent and extended inner side surface are determined according to the size of ice capable of being discharged.

The width of the ice outlet 153 should be greater than the minimum size capable of discharging the ice.

The least distance between the slanted inner surface 155*b* disposed at the lower side and the slanted inner surface 154*b* disposed at the upper side is defined as $\delta$. This $\delta$ is a vertical distance from the slanted inner surface 155*b* disposed at the lower side to the lower end of the slanted inner surface 154*b* disposed at the upper side.

In an embodiment, the least distance $\delta$ is greater than the maximum depth c of the unit receiving portion 112 of the ice making tray 110 and is less than the maximum diameter d of one receiving portion 112.

The least distance $\delta$ is greater than the maximum depth of the receiving portion 112 of the ice-making tray 110, because the least distance $\delta$ must be greater than the depth of the receiving portion 112, i.e. the thickness of ice, in order to discharge released ice through the ice outlet 153.

The receiving portion 112 can be shaped in various ways.

As described in the above, the ice-making tray according to the present invention may be installed at the door of the freezing chamber when it is installed in the refrigerator. In this embodiment, the door of the freezing chamber is a door that is hinged to the cabinet, in which the freezing chamber is provided, to selectively open or close the freezing chamber.

Since the inner side surface, which is installed in a direction of the inner side surface of the door, is configured with the higher slanted inner surface 154*b* surrounding the lower slanted inner surface 155*b*, it is difficult for users to approach the ice-making tray than otherwise, even when user's arm is bent.

Figure 4A:
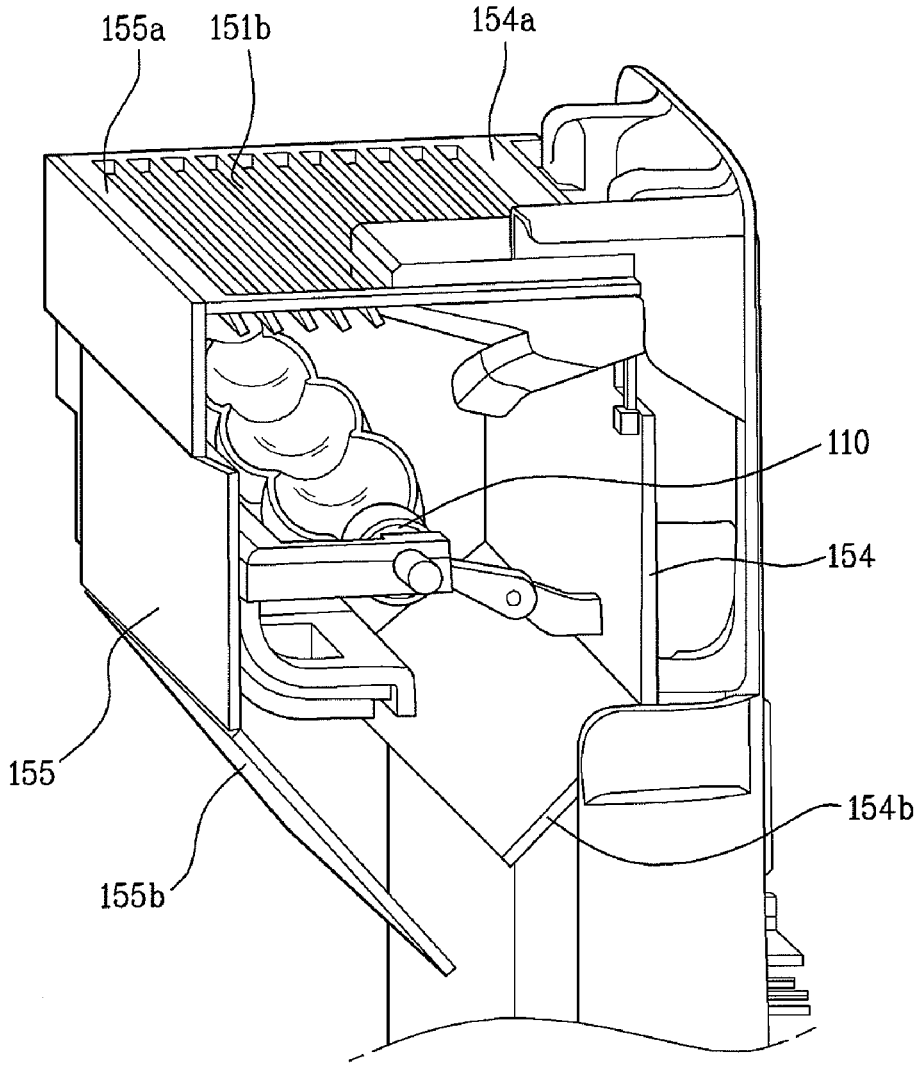
FIG. 4A and FIG. 4B illustrate an icemaker according to another embodiment of the present invention.
Figure 4B:
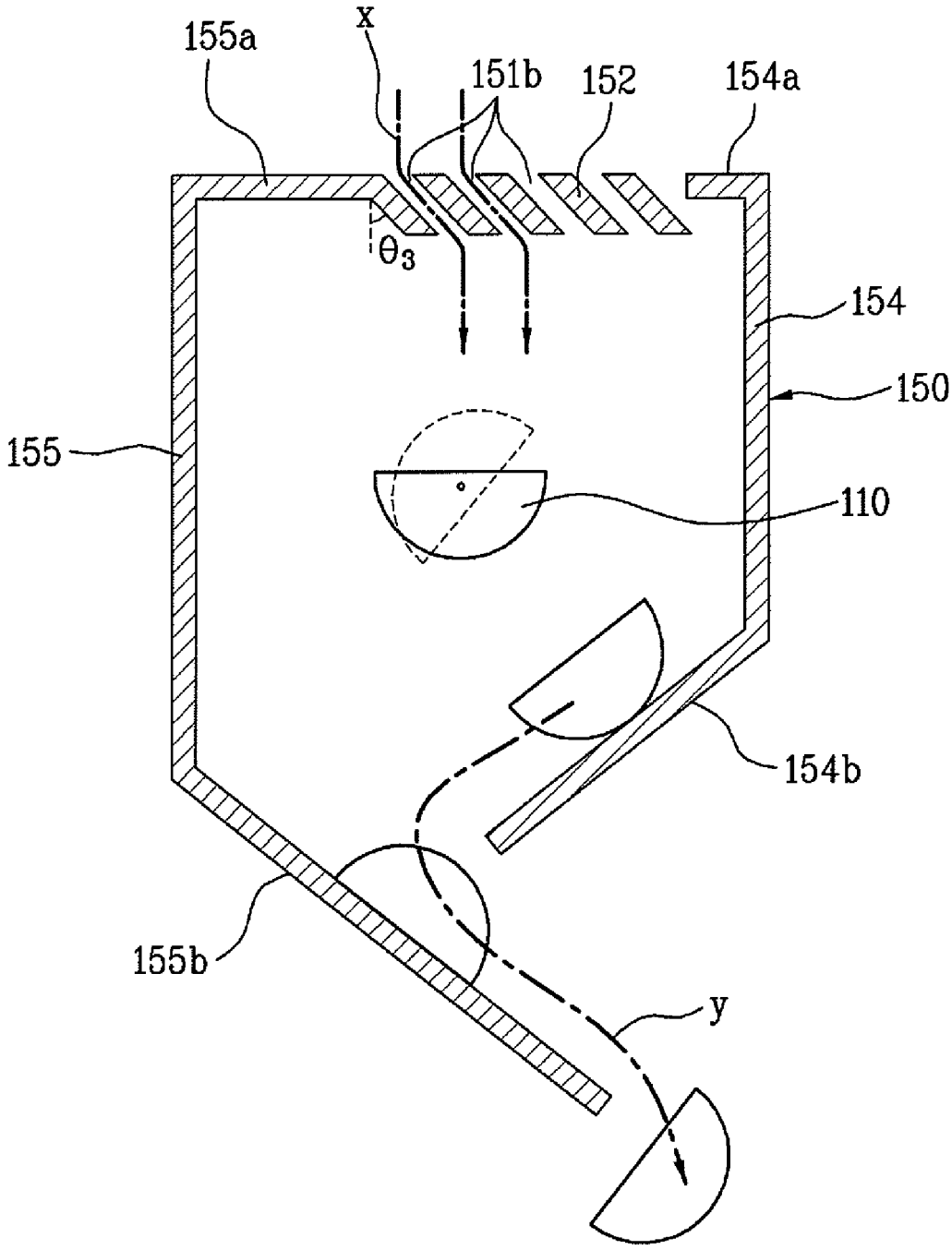

FIG. 4*a* is a perspective view of an icemaker having a housing 150, wherein a side surface of the housing is incised, and FIG. 4*b* is a cross-sectional view schematically showing an icemaker according to the present invention.

The overlapped explanation with the embodiment in FIG. 3 will be omitted from the embodiment in FIG. 4.

According to the embodiment in FIG. 4, the housing 150 surrounding the ice making tray 110, in which ice is made, is provided with a plurality of slot-like cold air inlet ports 151*b* that are formed by a plurality of slanted block members 152.

FIG. 4*b* illustrates the cold air inlet ports 151*b* with reference to the schematic cross-sectional view of the icemaker according to the present invention.

Cold air supplied into the upper part of the ice making tray 110 is supplied to the ice making tray provided in the housing via the cold air inlet ports 151*b* formed by the plurality of slanted block members 152.

The block members 152 at the upper part of the housing 152 are inclined at a specific angle. Block members 152 may be integrally formed with the housing 150, or may be separately made and installed at the upper part of the housing.

By adjusting the spacing between of the block members 152, it is possible to block user's fingers from the ice-making tray 110. For example, if the diameter of an object capable of passing through the cold air inlet port 151*a* is less than 10 mm, it is possible to prevent parts of the body, for example the finger of children, from touching tray 110.

To prevent straight conductive slender objects inserted into the cold air inlet port 151*b* from contacting tray 110, the angle θ3 of the block member 152 can be increased.

If the angle θ3 of the block member 152 is increased, the ice-making tray 110 cannot be seen from the upper part of the housing.

Figure 5A:
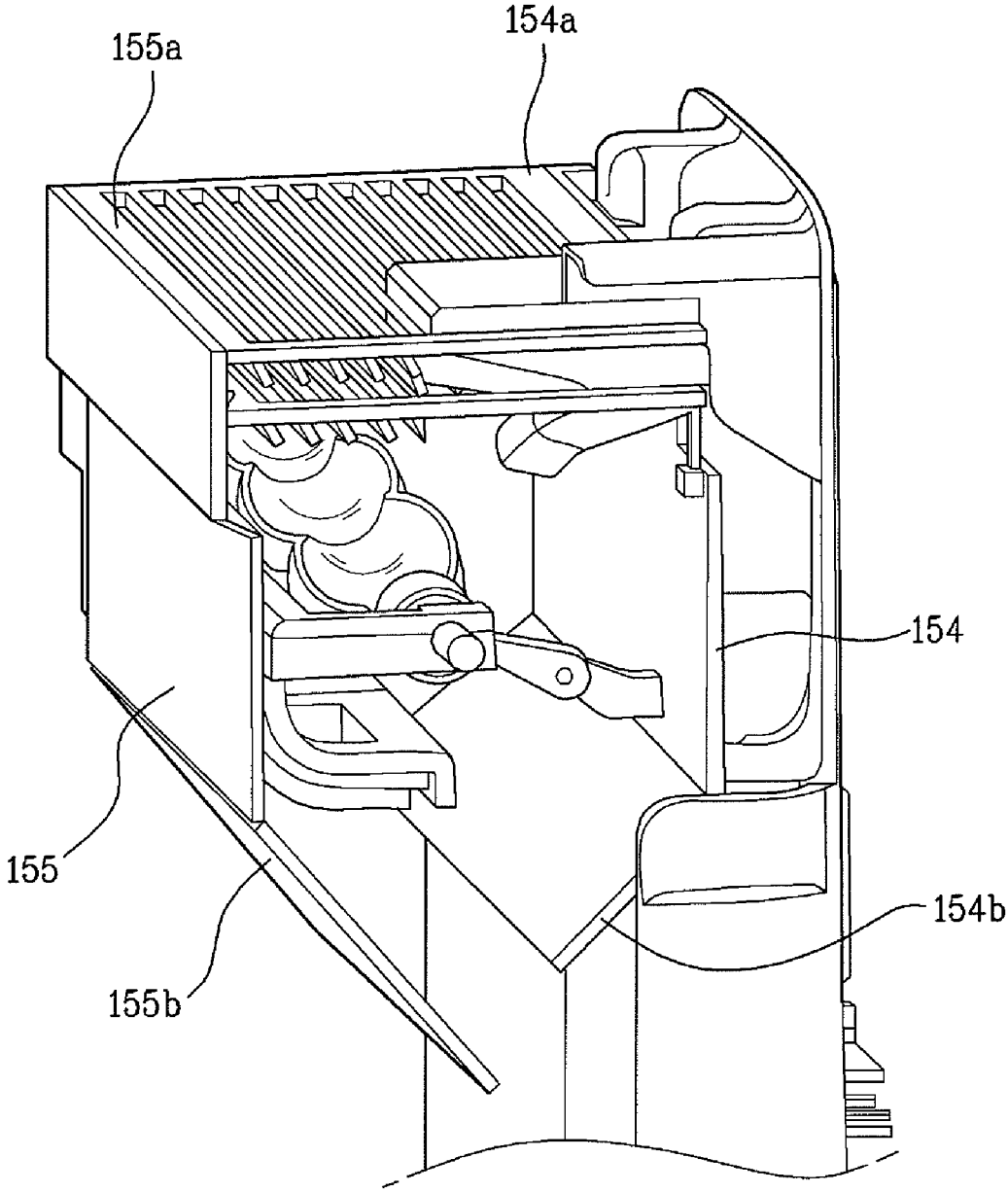
FIG. 5A and FIG. 5B show an icemaker according to further another embodiment of the present invention.
Figure 5B:
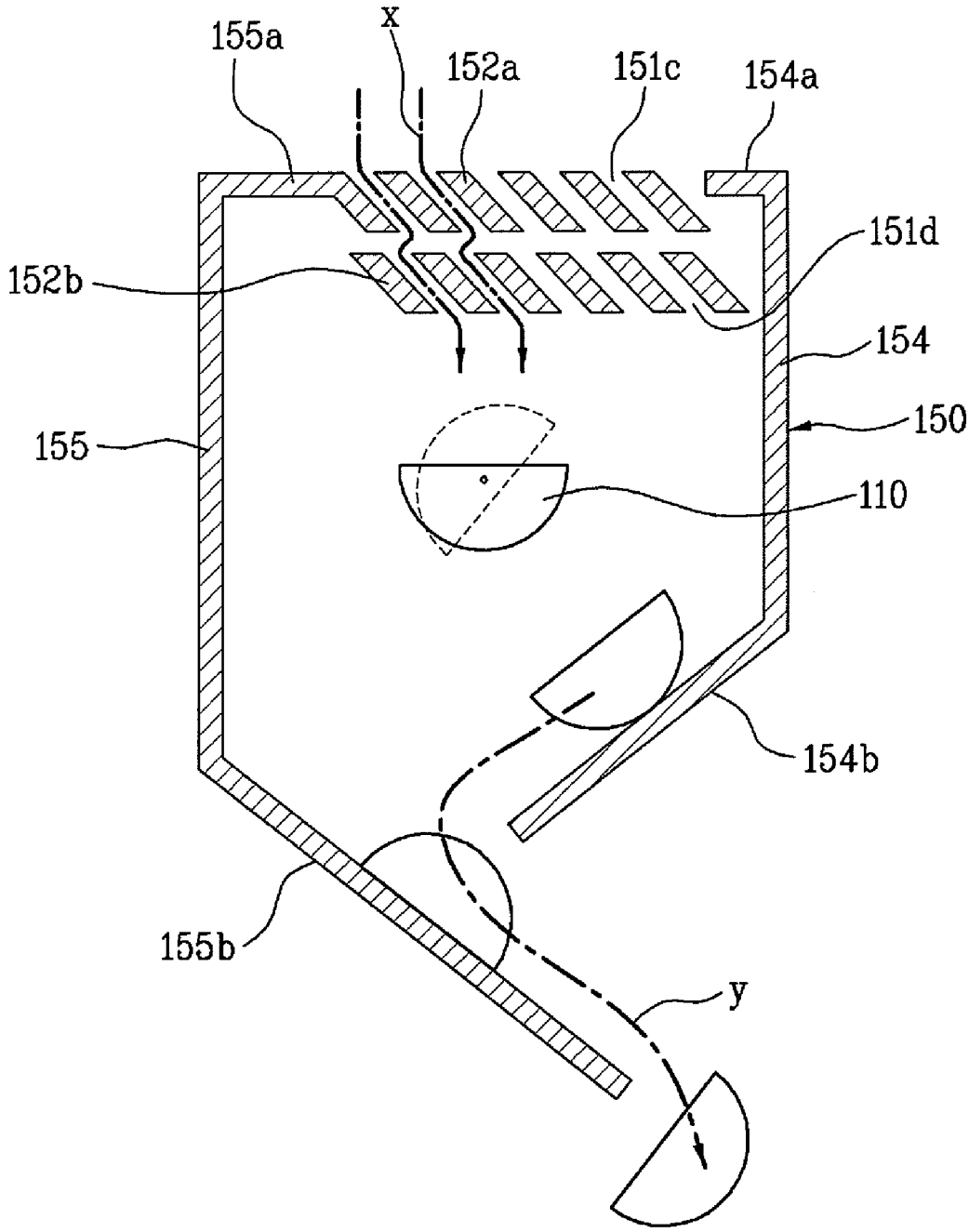

FIG. 5*a* is a perspective view of an icemaker having a housing 150, wherein a side surface of the housing is incised, and FIG. 5*b* is a cross-sectional view schematically showing an icemaker according to the present invention.

In the embodiment of FIGS. 5A and 5B, the block member constituting the cold air inlet port are arranged in double layers and the slot constituting the cold air inlet port is arranged in double layers.

The cold air inlet ports 151*c*, 151*d* in the shape of a slot will be explained with reference to FIG. 5*b*.

As shown in FIG. 5*b*, block members 152*a*, 152*b* are slantedly arranged in double layers with cold air inlet ports 151*c*, 151*d* formed by the block members overlapping each other. The cold air supplied from the upper part of the housing through the overlapped cold air inlet ports can be supplied into the ice-making tray 110 along the cold air passage X.

As shown in FIG. 5*a* and 5*b*, the angle θ3 of the block member 152 is high enough so that the ice-making tray cannot be seen from above the upper part of the housing.

With the horizontal position of the respective block member 152*a*, 152*b* is appropriately adjusted, the possibility of metallic objects touching the ice-making tray is minimized because the ice-making tray 110 cannot be seen from the upper part of the housing.

It is therefore possible to prevent electric shock from the conductive ice-making tray while sufficient cold air flows into the ice-making tray and the discharge of ice is unimpeded.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An icemaker, comprising:

an icemaking tray having a plurality of ice receiving portions in which water is stored to make ice, the icemaking tray comprising a material that generates heat when an electric current flows through the icemaking tray;

a controller for providing an electric current through the icemaking tray to perform an ice body separation; and a housing surrounding the ice making tray and provided with a cold air inlet port through which cold air supplied from an upper part of the ice making tray flows to the ice making tray along a bent channel, and an ice outlet through which ice moved from the ice making tray is discharged along a bent passage at a lower side of the housing;

wherein the cold air inlet port is a gap between spaced plates disposed at an upper part of the ice-making tray; and wherein the plates are positioned at different height and are parallel to each other.

2. The icemaker according to claim 1, wherein the plates overlap each other such that they are spaced apart at the upper part of the ice making tray.

3. An icemaker, comprising:

an icemaking tray having a plurality of ice receiving portions in which water is stored to make ice, the icemaking tray comprising a material that generates heat when an electric current flows through the icemaking tray;

a controller for providing an electric current through the icemaking tray to perform an ice body separation; and a housing surrounding the ice making tray and provided with a cold air inlet port through which cold air supplied from an upper part of the ice making tray flows to the ice making tray along a bent channel, and an ice outlet through which ice moved from the ice making tray is discharged along a bent passage at a lower side of the housing; and wherein the cold air inlet port is a plurality of slots formed by a plurality of slanted block members;

wherein the slots formed by the block members are formed as double layers at different heights.

* * * * *